United States Patent [19]

Van Camp

[11] Patent Number: 4,648,377

[45] Date of Patent: Mar. 10, 1987

[54] GAS CONVECTION OVEN AND HEAT EXCHANGER THEREFOR

[75] Inventor: Richard H. Van Camp, Tipp City, Ohio

[73] Assignee: Hobart Corporation, Troy, Ohio

[21] Appl. No.: 858,615

[22] Filed: May 1, 1986

[51] Int. Cl.[4] ..... F24C 15/32

[52] U.S. Cl. ..... 126/21 A; 126/91 A; 165/125; 432/176; 432/199

[58] Field of Search ..... 126/21 A, 21 R, 20, 126/39 C, 273 R, 91 A, 39 R; 99/473, 446, 474, 448, 475, 447; 34/196, 219; 432/176, 199; 165/125

[56] References Cited

U.S. PATENT DOCUMENTS

| | | | |
|---|---|---|---|
| 1,874,328 | 8/1932 | McCutcheon | 432/176 |
| 2,235,559 | 3/1941 | Mayer | 432/176 |
| 3,384,068 | 5/1968 | Perry et al. | 126/21 R |
| 3,590,803 | 7/1971 | Sauer | 126/21 R |
| 3,605,717 | 9/1971 | Sauer | 126/21 A |
| 3,669,090 | 6/1972 | Jung et al. | 126/21 A |
| 4,395,233 | 7/1983 | Smith | 126/21 A |
| 4,484,561 | 11/1984 | Baggott et al. | 126/21 A |

FOREIGN PATENT DOCUMENTS

| | | | |
|---|---|---|---|
| 2509565 | 9/1976 | Fed. Rep. of Germany | 126/21 A |
| 138625 | 10/1981 | Japan | 126/21 A |
| 332874 | 7/1980 | United Kingdom | 126/21 A |

*Primary Examiner*—James C. Yeung

*Attorney, Agent, or Firm*—Biebel, French & Nauman

[57] ABSTRACT

A gas convection oven includes a heating chamber having a gas combustion chamber formed therein and a blower positioned within the combustion chamber for circulating air through the heating and combustion chambers. The blower defines a low pressure inlet centrally of the combustion chamber for receiving air from the heating chamber and forcing it through the combustion chamber back into the heating chamber around the outer edges of the combustion chamber. A gas burner extends into the combustion chamber and includes a distally-mounted diverter for dividing and directing flame and combustion products into two different directions. A bifurcated heat exchanger defines first and second tubular passages which are aligned with and encompass the blower and define inlets aligned with the two different directions for receiving the combustion products from the burner. The first and second passages terminate in a junction box which passes the products of combustion into the low pressure inlet of the blower such that air drawn from the heating chamber is mixed with the combustion products and then passed over the bifurcated heat exchanger before being recirculated to the heating chamber.

12 Claims, 10 Drawing Figures

GAS CONVECTION OVEN AND HEAT EXCHANGER THEREFOR

BACKGROUND OF THE INVENTION

This invention relates generally to a commercial gas convection oven, and more particularly, to a bifurcated tubular heat exchanger which can be positioned within a limited width combustion chamber preferably formed within the heating chamber of such an oven to form a highly efficient convection oven within a limited amount of space.

In convection ovens, food is placed into a heating chamber to be thawed, fried, baked or otherwise cooked or processed by means of the application of heat. Food is processed within the heating chamber by moving heated air along a circulatory path which is defined to provide a selected and controllable temperature of substantial uniformity throughout the heating chamber. The circulatory path is generally defined by the interior walls of the heating chamber, by food supporting racks and possibly by baffling within the heating chamber when the chamber is empty. The air is moved around the circulatory path by means of a fan or blower which is positioned within the circulatory path and usually housed within a separate chamber adjacent to the heating chamber.

The circulated air in convection ovens has been heated by passage over and around electrically heated coils, steam pipes, heated flues or tubular heat exchangers which rely exclusively upon an exchange of heat between the particular heating element utilized and the circulating air to maintain the desired heating temperature in the oven. To increase the efficiency in a gas-fired convection oven, the products of combustion have been introduced directly into the circulating air path of the oven.

For example, in U.S. Pat. No. 4,484,561, a tubular heat exchanger comprises a single spiraling tube having a substantial diameter which passes around a conical central portion of a baffle interconnecting the heating chamber of the oven to an axial air inlet of a blower wheel or fan. The portion of the heat exchanger nearest its inlet end is naturally the most highly heated portion of the heat exchanger. To capitalize on the high heating of the inlet end of the heat exchanger, it has a cross-sectional area which is formed to provide an airfoil type effect for maximum thermal energy transfer to the air. Additional although substantially less heat is extracted from the remainder of the heat exchanger, which comprises approximately 75–88% of the heat exchanger, receives less heat, and transfers that heat to the air with less efficiency due to its relatively large diameter circular cross-section.

To extract still more heat from the gas combustion process for higher efficiency and more rapid heating of the convection oven, the products of combustion are introduced into the circulatory air path of the oven. To enhance the introduction of the products of combustion into the circulatory air path, the outlet of the tubular heat exchanger is positioned in the low pressure inlet of the blower such that the heated products of combustion are drawn into the blower and mixed with the air from the heating chamber. This mixture of air and combustion products is then passed over the heat exchanger to receive additional heat before being directed back into the heating chamber. The convection blower of the oven thus assists a fan which forms a part of and powers a gas burner of the cited prior art patent.

Unfortunately, in the illustrated spiral heat exchanger of the cited prior art patent, maximum heat transfer appears to be limited to no more than approximately 25% of the heat exchanger which also must be of a substantial diameter to accommodate sufficient combustion products to rapidly heat the oven. The large diameter of the spiral heat exchanger tube coupled to the baffle leading to the convection blower dictates that the chamber containing the convection blower be of a substantial dimension relative to the heating chamber of the oven, for example, in the illustrated embodiments, approximately 50%. Further, altering the formation of a portion of the heat exchanger to have an airfoil cross-section adds to the cost of the heat exchanger due to increased fabrication, inventory and assembly costs.

It is, thus, apparent that the need exists for an improved heat exchanger for a gas convection oven which will not only provide rapid and efficient introduction of heat from a gas burner into the circulatory air path of a convection oven, but one which can be constructed inexpensively and will permit compact construction within a limited size convection blower chamber or combustion chamber of a gas convection oven.

SUMMARY OF THE INVENTION

In accordance with the present invention, a bifurcated tubular heat exchanger conducts the products of combustion away from a gas burner via two passages and ultimately into the circulating air path through the heating chamber of a gas convection oven to overcome the deficiencies of the prior art. By bifurcating the heat exchanger, the maximum heat transfer portion of the heat exchanger is increased and approximately doubled; however, the heat exchanger can be made quite narrow such that it can be accommodated within a narrow gas combustion chamber located adjacent to or preferably included within a heating chamber of a gas convection oven. By placing a convection blower within the gas combustion chamber and forming the bifurcated heat exchanger to have first and second tubular passages substantially aligned with and encompassing the convection blower, the gas combustion chamber can be formed to occupy as little as one-eighth of the total combined dimensions of the heating chamber and the gas combustion chamber.

In accordance with one aspect of the present invention, a gas convection oven comprises a heating chamber including a gas combustion chamber formed therein with convection blower means positioned within the combustion chamber for circulating air through the heating chamber and the combustion chamber. The blower means has a low pressure inlet located centrally of the combustion chamber for receiving air from the heating chamber and forcing it through the combustion chamber and back into the heating chamber around the outer edges of the combustion chamber. Gas burner means extend into the combustion chamber for combusting an appropriate mixture of gas and air, with the gas burner means including diverter means for substantially equally dividing and directing flame and combustion products into two different directions.

Bifurcated heat exchanger means are provided for conducting therethrough the products of combustion from the gas burner. The heat exchanger means defines first and second tubular passages which are substantially aligned in the same plane with and encompass the convection blower means, with the first and second passages having inlets aligned with the two different directions for receiving the flame and combustion products divided by the diverting means of the gas burner means. The first and second passages terminate in outlet means for extending the first and second passages into the low pressure inlet of the convection blower means such that air drawn into the blower means is heated both by mixture with combustion products from the outlet means of the heat exchanger and also by passage over the surfaces of the first and second passages of the heat exchanger as the mixture of air and combustion products is circulated through the combustion chamber and back into the heating chamber. By bifurcating the heat exchanger means, the effective maximally-heated portion of the heat exchanger means adjacent its inlet is approximately doubled.

Preferably, the outlet means of the heat exchanger comprises an angled junction box extending the first and second passages toward the heating chamber and into the low pressure inlet of the convection blower means. The cross-section of the junction box adjacent the low pressure inlet is sufficient to exhaust the first and second passages, and also elongated to present a reduced thickness as compared to the cross-section of the passages such that the gas combustion chamber is narrow and substantially equal in width to the sum of the widths of the convection blower means and the reduced thickness of the junction box adjacent the blower means low pressure inlet.

In accordance with another aspect of the present invention, a gas convection oven comprises an enclosable heating chamber with vertical sides and a top and bottom. A gas combustion chamber is formed within and along one side of the heating chamber and is defined by a vertical partition plate having a central opening and peripheral openings along at least two edges thereof for enabling recirculation of air from the heating chamber through the central opening of the partition plate, the combustion chamber and the peripheral openings of the partition plate back to the heating chamber. A fan having a horizontal axis generally aligned with the central opening through the partition plate includes a low pressure inlet located centrally thereof facing the central opening in the partition plate and peripheral blades for forcing air entering the inlet in a radially outward direction. Motor means are provided for driving the fan.

A bifurcated tubular heat exchanger is arranged in a substantially vertical plane and defines first and second passages which are substantially equal in length and cross-section and are aligned in the same plane with and encompass at least a major portion of the fan. Combustion conduit means are provided for communicating a gas burner to the heat exchanger to introduce heated combustion products into the heat exchanger, with the conduit means being arranged to distribute the products substantially equally into the first and second passages of the bifurcated heat exchanger. Heat exchanger outlet means at the distal ends of the first and second passages provide for conducting combustion products to the fan inlet. An exhaust outlet is provided from the heating chamber to the exterior of the oven to enable a controlled escape of combustion products therefrom.

Preferably, the combustion conduit means comprises a first junction box from which said first and second passages extend in opposite directions and vertically along the sides of the combustion chamber, with the first and second passages being similarly shaped and symmetrical. The outlet means may comprise extensions of the first and second passages, or preferably, it comprises a second junction box interconnecting the ends of the first and second passages and extending them radially inwardly from the heat exchanger to the fan inlet. To facilitate housing the heat exchanger in a narrow dimension gas combustion chamber, the second junction box extends laterally from the heat exchanger passages toward the partition plate and is angled to extend radially inwardly therefrom between the plate and the fan, with the radial inward extension being narrow relative to the passages.

Preferably, the combustion conduit means is positioned along the bottom of the heat exchanger, and the outlet means is positioned along its top. However, the combustion conduit means may be formed at any position along the heat exchanger and once positioned, it fixes the position of the outlet means, since the combustion conduit means and the outlet means are positioned substantially diametrically opposite to one another. Preferably, the combustion conduit means and the outlet means are in general vertical alignment with the central opening in the partition plate. Such positioning appears to best facilitate rapid and even heating of the convection gas oven. For this configuration, the first and second passages are generally U-shaped and are arranged generally symmetrically about the fan. It is apparent that the heat exchanger may comprise essentially vertical and horizontal tubing, with the first and second junction boxes positioned at diametrically opposite corners of the combustion chamber. Partition plate peripheral openings are preferably provided at least along a major portion of the top and the bottom of the plate.

It is an object of the present invention to provide a highly efficient gas convection oven capable of quick and even distribution of heat throughout a heating chamber; to provide in a gas convection oven a heat exchanger and fan so located within a combustion chamber as to provide a highly efficient distribution of heat; and, to provide a compact heat exchanging system within a combined cooking and combustion chamber of a gas convection oven such that the space occupied by the oven is minimized to facilitate mounting the oven on a stand or table where space may be at a premium.

Other objects and advantages of the invention will be apparent from the following description, the accompanying drawings and the appended claims.

DETAILED DESCRIPTION OF THE INVENTION

Figure 1:
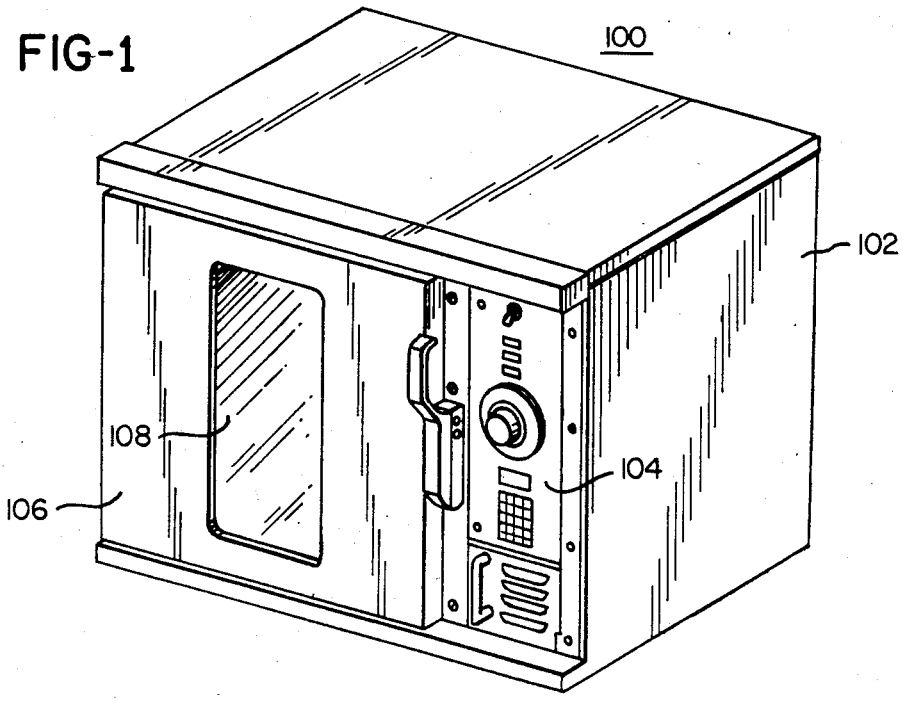
FIG. 1 is a perspective view of a gas convection oven in accordance with the present invention.
Figure 2:
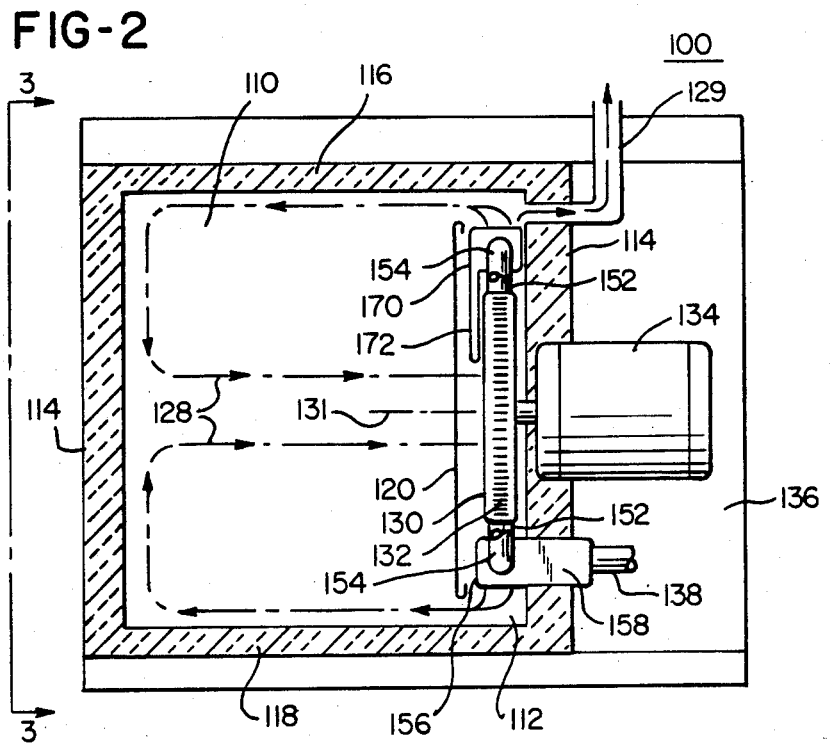
FIG. 2 is a partially-sectioned front view of the gas convection oven of FIG. 1 in schematic form.
Figure 3:
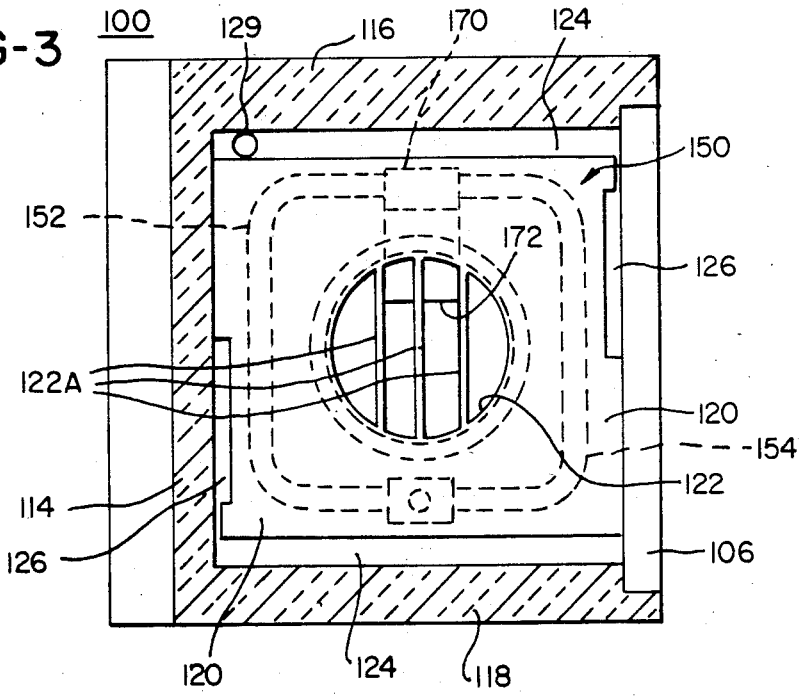
FIG. 3 is a partially-sectioned side view of the convection oven of FIG. 1 in schematic form.

A gas convection oven 100 in accordance with the present invention is shown in FIGS. 1–3. The oven 100 comprises a compact box-like structure 102 having a control panel 104 on its front face, and an access door 106 with a viewing panel 108 provided to observe the contents of the oven 100. The door 106 permits access to a combination enclosable heating chamber 110 and gas combustion chamber 112. The combined heating chamber 110 and gas combustion chamber 112 have insulated sidewalls 114 and insulated top and bottom walls 116 and 118, respectively, as best seen in FIG. 2. In the preferred embodiment as shown, the gas combustion chamber 112 is formed within and along one side of the heating chamber 110, although it should be apparent that the combustion chamber 112 could also be positioned along the top, bottom or back of the heating chamber, if desired.

Figure 4A:
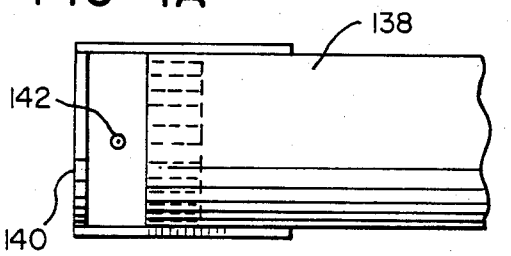
FIGS. 4A–4C show top, side and end views, respectively, of the gas burner diverter for the gas convection oven of the present invention.
Figure 4B:
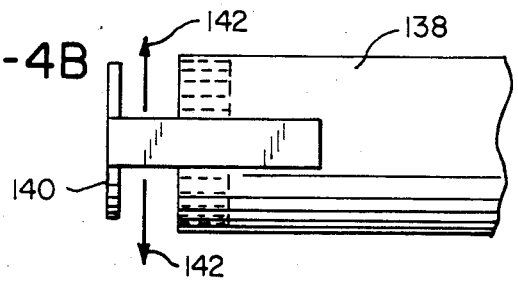
Figure 4C:
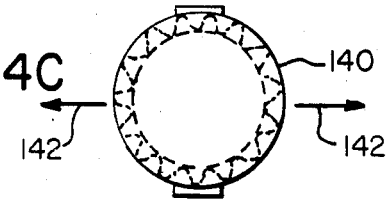
Figure 4:
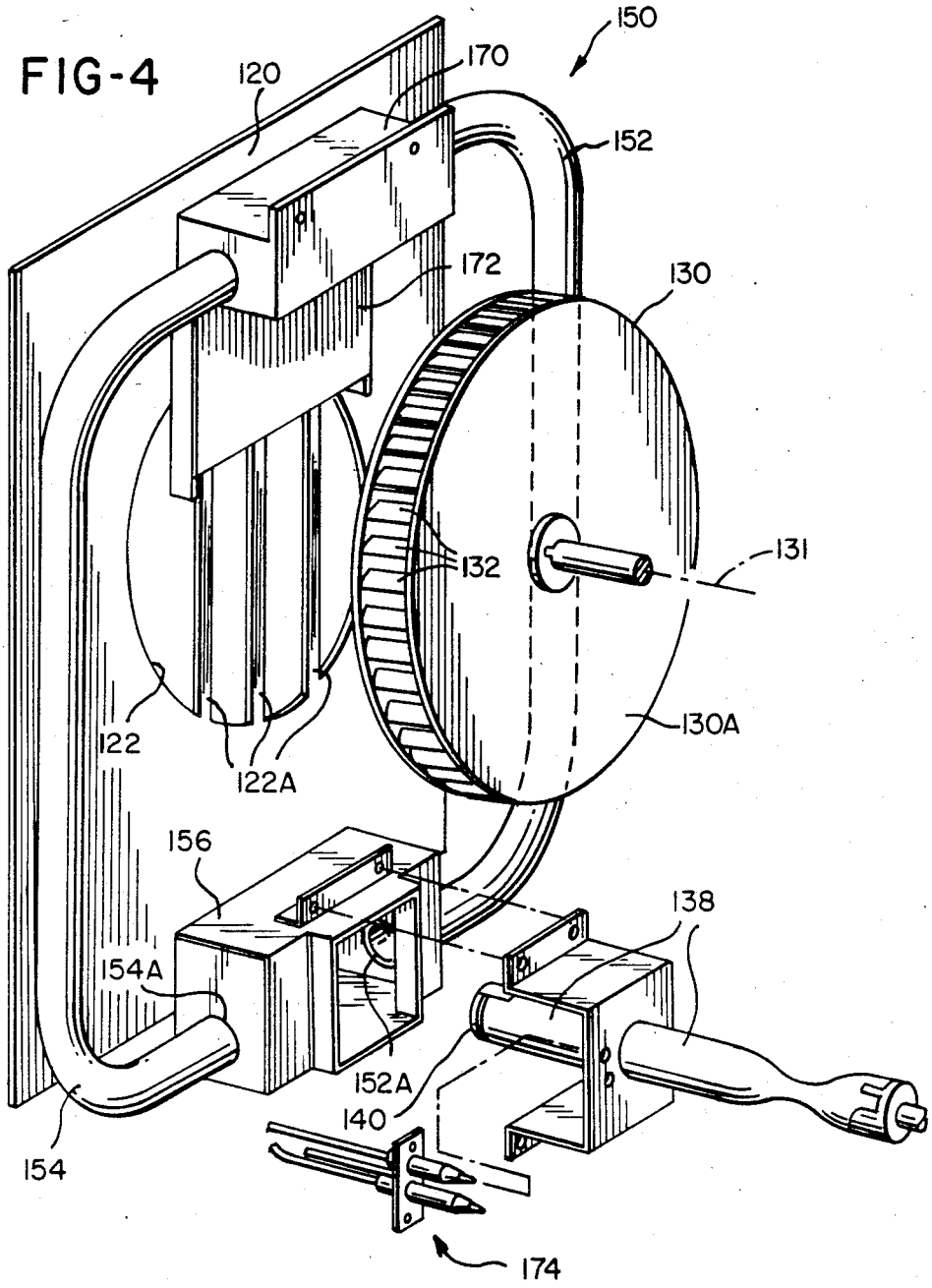
FIG. 4 is an exploded perspective view showing the partition plate separating the heating and combustion chambers, the fan, the gas burner and the bifurcated heat exchanger of the present invention.

The gas combustion chamber 112 is defined by a vertical partition plate 120 which separates the combustion chamber 112 from the heating chamber 110. The partition plate 120 has a central opening 122 and peripheral openings 124 and 126 along its top and bottom edges and along its side edges, respectively, for enabling recirculation of air from the heating chamber 110 through the central opening 122, the combustion chamber 112 and out through the peripheral openings 124 and 126 back to the heating chamber 110, as shown generally by the arrowed dotted lines 128 in FIG. 2. Narrow bars 122A, as shown in FIGS. 3 and 4, extend across the opening 122 in the partition plate 120 to prevent items placed within the heating chamber 110 from being inadvertently passed through the opening 122 into the combustion chamber 112. An exhaust outlet 129 is provided from the combined heating and combustion chambers 110,112 to the exterior of the oven 100 to enable a controlled escape of combustion products.

A convection blower or fan 130 having a horizontal axis 131 generally aligned with the central opening 122 through the partition plate 120 defines a low pressure inlet located centrally of the fan and facing the heating chamber 110 through the central opening 122. The fan 130 includes peripheral blades 132 for forcing air entering the fan inlet through the opening 122 in a radially outward direction as is well known with such fans. A motor 134 is positioned primarily within a control chamber 136 of the oven 100 for driving the fan 130.

Gas burner means 138, as best shown in FIG. 4, preferably comprises an induced draft gas burner; however, other known gas burners can be utilized in the present invention. The gas burner 138 extends from the control chamber 136 into the combustion chamber 112 for combusting an appropriate mixture of gas and air within the combustion chamber 112. The gas burner 138 includes diverter means 140 for substantially equally dividing and directing flame and combustion products into two different directions as shown by the arrows 142 in FIGS. 4A, 4B and 4C.

Bifurcated heat exchanger means 150 is provided for conducting therethrough the products of combustion from the gas burner 138 to the inlet to the blower 130 as will become apparent. The heat exchanger 150 defines first and second tubular passages 152 and 154 which are substantially in alignment with the plane of the blower 130, and substantially encompass the blower 130. The plane of the blower 130 as used herein can comprise any one of a series of planes perpendicular to the blower axis 131, parallel to the backing plate 130A of the blower 130 and passing through the blower 130 at any point from the backing plate 130A to the front of the blower 130. While it is preferred to have the heat exchanger 150 substantially in alignment with the plane of the blower 130, particularly for compact construction, it is apparent that the bifurcation of the heat exchanger of the present invention is also applicable for use with baffle structures such as that shown in previously cited U.S. Pat. No. 4,484,561. Combustion conduit means, in the preferred embodiment comprising a first junction box 156, receives the burner 138 for communicating the diverted flame and combustion products from the burner 138 into the bifurcated heat exchanger 150.

In particular, inlets 152A and 154A of the first and second passages 152 and 154 are secured into opposite ends of the junction box 156 such that the conduit means is arranged to distribute the products of combustion substantially equally into the first and second passages 152 and 154 of the bifurcated heat exchanger 150. As will be apparent from a review of FIGS. 4 and 4A–4C, the two different directions of the flame and combustion products indicated by the arrows 142 and diverted and directed by the diverter means 140 are directed toward the inlets 152A and 154A of the first and second passages 152 and 154 of the bifurcated heat exchanger 150. A combustion air inlet manifold 158, see FIG. 2, is formed into the insulated sidewall 114 between the combustion chamber 112 and the control chamber 136.

Heat exchanger outlet means taking the form of a second junction box 170 in the preferred embodiment of the invention is provided at the distal ends of the first and second passages 152 and 154 for conducting combustion products to the inlet of the fan 130. It is apparent that the first and second passages 152 and 154 could be extended directly into the inlet as suggested hereinafter with reference to FIGS. 5–7, and may be preferred for certain applications even though such embodiments may lead to widening the gas combustion chamber 112.

The second junction box 170 receives the distal ends of the first and second heat exchanger passages 152 and 154, and extends laterally from the heat exchanger passages 152, 154 toward the partition plate 120. At a point beyond the fan 130, the second junction box 170 defines an angled extension 172 which projects radially inwardly between the plate 120 and the fan 130 into the inlet of the fan 130. The angled inward extension 172 is widthwise expanded such that it can properly exhaust the passages 152 and 154, and yet be made narrow relative to the passages 152 and 154 to enable the overall width of the combustion chamber 112 to be narrow. It is apparent that the combustion chamber 112 can be constructed to have a width substantially equivalent to the combined width of the fan 130 and the narrow dimension of the angled inward extension 172 of the second junction box 170 when compactness is a design objective. A commercially available direct spark ignition system 174 is connected into the system and controlled in a conventional manner.

Figure 5:
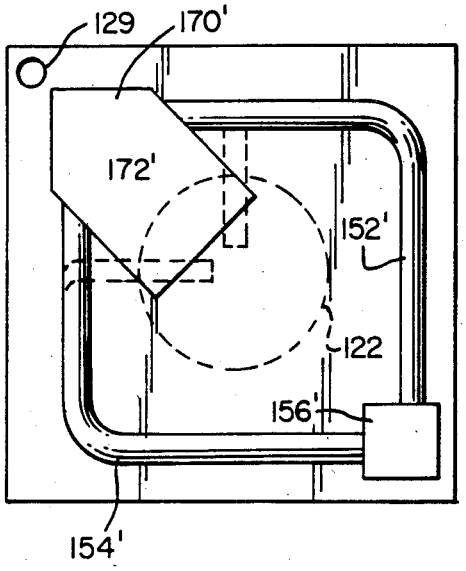
FIGS. 5–7 schematically show alternate embodiments of the bifurcated heat exchanger in accordance with the present invention.

In the preferred embodiment of the heat exchanger 150, the first junction box 156 and the second junction box 170 are positioned in general vertical alignment with the central opening 122 through the partition plate 120. Such positioning appears to best facilitate rapid and even heating of the convection gas oven 100. For this preferred embodiment, the first and second passages 152 and 154 are generally U-shaped and are arranged generally symmetrically about the fan 130. It is apparent that alternate positions of the first and second junction boxes 156 and 170 are possible, for example, as shown in FIG. 5, where the heat exchanger passages 152' and 154' comprise essentially vertical and horizontal tubing having a right angle bend, with the first and second junction boxes 156' and 170' being positioned at diametrically opposed corners of the combustion chamber 112.

Figure 6:
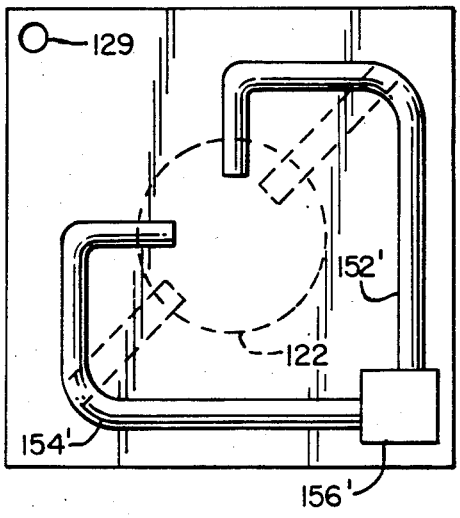
Figure 7:
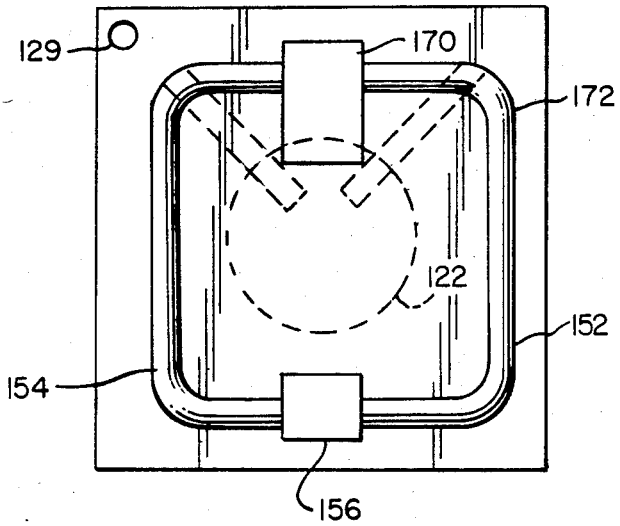

The first junction box 156 is preferably positioned along the bottom of the heat exchanger 150, and the second junction box 170 along its top. However, the first and second junction boxes may be positioned essentially anywhere around the bifurcated heat exchanger. However, the first and second junction boxes 156 and 170 must be positioned substantially diametrically opposite to one another to maintain an approximate equivalence and balance between the first and second passages 152 and 154. As shown by the dotted line drawings of the distal ends of the passages 152',152 and 154',154 in FIGS. 5 and 7 and by the solid and dotted line drawings of the distal ends of the passages 152' and 154' in FIG. 6, the passages 152 and 154 can be terminated directly into the inlet of the fan 130 and thus eliminate the second junction box 170. Accordingly, FIGS. 5–7 are merely suggestive of the large variety of embodiments which are possible in accordance with the present invention.

It is apparent that a gas convection oven including an improved bifurcated heat exchanger which will not only provide rapid and efficient heating of the oven, but also can be constructed inexpensively and will permit compact construction within a limited size combustion chamber of a gas convection oven has been disclosed in accordance with the preceding description. By including a bifurcated heat exchanger, the maximum energy transfer portion of the heat exchanger has been substantially expanded and approximately doubled due to the diversion and direction of the flame and related combustion products into the two passages of the bifurcated heat exchanger. In addition, the width of the heat exchanger, i.e., the diameter of the first and second passages 152 and 154, can be reduced in comparison to the prior art heat exchangers and still carry the same volume of combustion products due to the bifurcation.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A gas convection oven comprising:

a heating chamber including a gas combustion chamber formed therein;

convection blower means positioned within said combustion chamber for circulating air through said heating chamber and said combustion chamber, said blower means having a low pressure inlet located centrally of said combustion chamber for receiving air from said heating chamber and forcing said air through said combustion chamber and back into said heating chamber around the outer edges of said combustion chamber;

gas burner means extending into said combustion chamber for combusting an appropriate mixture of gas and air, said gas burner means including diverter means for substantially equally dividing and directing flame and combustion products into two different directions; and bifurcated heat exchanger means for conducting therethrough the products of combustion from said gas burner means, said heat exchanger means having first and second tubular passages substantially aligned with and encompassing said convection blower means, said first and second passages having inlets aligned with said two different directions for receiving the flame and combustion products divided by said diverting means, and terminating in outlet means for extending said first and second passages into the low pressure inlet of said convection blower means whereby air drawn into said blower means is heated both by mixture with combustion products from said outlet means of said heat exchanger and also by passage over the surfaces of said first and second passages as the mixture of air and combustion products is circulated through said combustion chamber and back into said heating chamber.

2. A gas convection oven as claimed in claim 1 wherein said outlet means comprises an angled junction box extending said passages toward said heating chamber and into the low pressure inlet of said convection blower means, the cross-section of said junction box adjacent said low pressure inlet being sufficient to exhaust said passages and elongated to present a reduced thickness as compared to the cross-section of said passages such that the gas combustion chamber is substantially equal in width to the sum of the widths of the convection blower means and the reduced thickness of said junction box adjacent said low pressure inlet.

3. A gas convection oven comprising:

an enclosable heating chamber with vertical sides and a top and bottom;

a gas combustion chamber formed within and along one side of said heating chamber and defined by a vertical partition plate having a central opening and peripheral openings along at least two edges thereof for enabling recirculation of air from said heating chamber through said central opening and said combustion chamber and out through said peripheral openings back to said heating chamber;

a fan having a horizontal axis generally aligned within the central opening through said partition plate, said fan having a low pressure inlet located centrally thereof and facing said central opening and further including peripheral blades for forcing air entering said inlet in a radially outward direction;

motor means for driving said fan;

a bifurcated tubular heat exchanger arranged in a substantially vertical plane and defining first and second passages of substantially equal length and cross-section aligned with and encompassing at least a major portion of said fan;

a gas burner;

combustion conduit means for communicating said burner to said bifurcated heat exchanger to introduce heated combustion products into said heat exchanger, said conduit means being arranged to distribute said products substantially equally into said first and second passages of said bifurcated heat exchanger;

heat exchanger outlet means at the distal ends of said first and second passages for conducting combustion products to said fan inlet; and an exhaust outlet from said heating chamber to the exterior of said oven to enable a controlled escape of combustion products therefrom.

4. A gas convection oven as claimed in claim 3 wherein said combustion conduit means comprises a first junction box, and wherein said first and second passages are similarly-shaped, symmetrical and extend in opposite directions from said first junction box and vertically along the sides of said combustion chamber.

5. A gas convection oven as claimed in claim 4 wherein said outlet means comprises a second junction box interconnecting the ends of said first and second passages and extending radially inwardly from the heat exchanger to the fan inlet.

6. A gas convection oven as claimed in claim 5 wherein said second junction box extends laterally from the heat exchanger passages toward said partition plate and is angled to extend radially inwardly therefrom between said plate and said fan, the angled inward extension of said second junction box being narrow relative to said passages to enable the overall width of the combustion chamber to be limited to substantially the combined width of said fan and the narrow dimension of the angled inward extension of said second junction box.

7. A gas convection oven as claimed in claim 3 wherein said combustion conduit means is positioned along the bottom of said heat exchanger and said outlet means is positioned along its top, said combustion conduit means and said outlet means being substantially diametrically opposite to one another.

8. A gas convection oven as claimed in claim 7 wherein said partition plate peripheral openings are provided at least along a major portion of the top and the bottom of said plate.

9. A gas convection oven as claimed in claim 7 wherein said combustion conduit means and said outlet means are generally in vertical alignment with the central opening in said plate.

10. A gas convection oven as claimed in claim 4 wherein said passages are generally U-shaped.

11. A gas convection oven as claimed in claim 5 wherein said first and second junction boxes are of the same general width, and wherein said passages are U-shaped with the legs thereof being essentially of the same length, whereby said first and second junction boxes and passages provide a heat exchanger arranged generally symmetrically about said fan.

12. A gas convection oven as claimed in claim 5 wherein said heat exchanger comprises essentially vertical and horizontal tubing with said first and second junction boxes positioned at diametrically opposed corners of the combustion chamber.

* * * * *